US006502632B1

(12) United States Patent
Pittman

(10) Patent No.: US 6,502,632 B1
(45) Date of Patent: Jan. 7, 2003

(54) WELL CAP APPARATUS

(76) Inventor: James R. Pittman, 84111 N. Factory Rd., Folsom, LA (US) 70437

( * ) Notice: Subject to any disclaimer, the term of this patent is extended or adjusted under 35 U.S.C. 154(b) by 28 days.

(21) Appl. No.: 09/818,356

(22) Filed: Mar. 27, 2001

(51) Int. Cl.[7] ..... E21B 33/02; E21B 19/00
(52) U.S. Cl. ..... 166/75.13; 138/89; 166/379
(58) Field of Search ..... 138/89; 166/95.1, 166/97.1, 75.13, 92.1, 379; 220/378

(56) References Cited

U.S. PATENT DOCUMENTS

| | | | | | |
|---|---|---|---|---|---|
| 2,092,261 | A | * | 9/1937 | Rector | 138/89 |
| 2,562,946 | A | * | 8/1951 | Read | 138/89 |
| 3,631,895 | A | | 1/1972 | Medina | 138/89 |
| 3,875,999 | A | | 4/1975 | Libert | 166/85 |
| 3,963,054 | A | * | 6/1976 | Martin | 138/89 |
| 3,998,245 | A | * | 12/1976 | Martin | 138/89 |
| 4,129,151 | A | * | 12/1978 | Henson | 138/89 |
| 4,202,376 | A | * | 5/1980 | Forsell | 138/113 |
| 4,334,578 | A | | 6/1982 | Labrum | 166/75 |
| 4,457,448 | A | | 7/1984 | Beagell | 220/327 |
| 4,715,439 | A | | 12/1987 | Fleming | 166/68 |
| 4,747,453 | A | | 5/1988 | Howard, Sr. | 166/379 |
| 4,848,458 | A | | 7/1989 | Holdsworth | 166/92 |
| 4,972,905 | A | * | 11/1990 | Henson | 138/89 |
| 5,099,917 | A | | 3/1992 | Roser | 166/51 |
| 5,184,608 | A | | 2/1993 | Hale, III | 138/89 |
| 5,289,882 | A | * | 3/1994 | Moore | 166/379 |
| 5,701,953 | A | * | 12/1997 | Stecker et al. | 166/379 |

* cited by examiner

*Primary Examiner*—David Bagnell
*Assistant Examiner*—Daniel P Stephenson
(74) *Attorney, Agent, or Firm*—Garvey, Smith, Nehrbass & Doody, L.L.C.; Charles C. Garvey, Jr.

(57) ABSTRACT

A well capping apparatus for capping a generally vertically positioned well pipe includes a body that provides an upper surface and side wall portions as well as a lower surface portion that includes a downwardly facing socket that generally conforms to the upper end portion of the well pipe at the well head and protectively covers it. The body includes an annular portion that encircles the upper end portion of the well pipe and preferably contacting the outer cylindrically shaped surface of the upper end portion of the well pipe. A central cavity is provided within the body having a water conveying function through the body. A pair of larger diameter apertures are provided on the body, each communicating with the central cavity at spaced apart positions on the body. A plurality of smaller diameter apertures are on the body, each communicating with the central cavity. First and second water conveying flow lines are connected to the body (preferably removably connected) so that water in the flow lines communicate with water in the central cavity, the first of the flow lines being a generally vertically oriented flow line that is contained within the well pipe and the second flow line being attachable to the body at one of the larger diameter apertures on the outer surface of the body. A plurality of fittings are provided, each connectable to the body at selected apertures, the fittings being at least two fittings selected from the group comprised of a sealing plug fitting, a sample dispensing spigot, a lifting fitting, and a pump support hanger fitting.

20 Claims, 4 Drawing Sheets

WELL CAP APPARATUS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to water wells, and more particularly to an improved cap arrangement that is placed on the top of the well pipe at the well head, providing improved sealing with the upper end portion of the well pipe and improved features for enabling easy access and well services, and numerous desired connections.

2. General Background of the Invention

When a water well is to be drilled, drilling equipment provides a generally vertically oriented wellbore that can extend many hundreds of feet into the earth. At least the upper end portion of this wellbore is typically lined with a pipe of selected diameter and material such as, for example, a four inch diameter plastic pipe.

At the wellhead, the upper end portion of the pipe is typically capped with a fitting. The "well cap" fitting usually fits inside the bore of the well pipe at the extreme upper end of the well pipe. This fitting is sometimes removably attached so that the well can be opened to provide access for servicing the well, removing the well pump, and/or for adding chemicals (such as chlorine) to the well.

A number of patents have issued that cover well cap constructions, illustrative examples being discussed hereinafter.

An example of a well cap construction is seen in U.S. Pat. No. 3,631,895 entitled "Well Cap". In the '895 patent, a well cap for the end of a well casing includes end wall means and annular skirt means depending therefrom adapted to be telescoped around an upper end portion of the case. Annular sealing chamber means are defined on an inside surface of the skirt wall means radially outwardly of the sidewall of said casing. A deformable sealing ring is mounted in the chamber means for sealing between the skirt wall and the well casing. A compression ring means in the chamber means around the sealing ring compresses the ring radially inwardly against the sidewall of the casing.

U.S. Pat. No. 3,875,999 discloses a well capping assembly in which a cylindrical cap is fitted into an annular well casing head and is formed with a pair of vertical passages. Lines are sealed to one passage to convey water under pressure through the cap, and an opening directs water from that passage to a sealing groove between a pair of seals fitted between the cap and the casing. In the second passage, an assembly is fitted for sealing a second pair of seals around a conduit running through that passage, and opposing direct water under pressure from the sealing groove to a second sealing groove defined between the second pair of seals. Alternatively, the assembly and conduit can be removed from the second passage and lines sealed to that passage so that a pair of water pressure lines pass through the cap.

U.S. Pat. No. 4,334,578 discloses a well casing closure for closing and covering the top of a well casing extending above the surface of the ground. The invention is characterized by a hollow cylindrical member closed on one end and open on the other end of such dimension as to fit over the top of the well casing and to provide a reasonably snug fit about the exterior of the casing; it is further characterized by utilizing an "O" ring or the like, for sealing between the interior of the closure and the exterior of the casing; additionally, a locking mechanism is incorporated so that the closure may be locked in place over the opening and only removed by one having a key to the lock.

A gasketless well casing cap is disclosed in U.S. Pat. No. 4,457,448. The '448 patent discloses a cap assembly for sealing engagement with the upper end of a cylindrical steel well casing. The assembly provides two initially separate, upper and lower sections. The lower section has a major opening therethrough for encircling the upper end of the well casing, the diameter of said opening tapering from a dimension at the lower side which is slightly larger than the diameter of the casing, to a slightly smaller diameter at the upper side. The material of the cap and dimensions of the major opening relative to the outside diameter of the well casing are such that the lower section may be manually inserted on the casing, with the latter extending completely through the major opening, whereby the lower section is in tightly sealing engagement with the casing without requiring a gasket. The upper cap section provides a cover for the lower section and includes a recessed portion bounded by a lip of continuous, closed outline extending downwardly from the lower surface of the upper section. After the lower section is engaged with the casing, the upper section is bolted thereto with the upper section lip engaging, and preferably slightly embedded in the upper surface of the lower section to seal the opening therein, and thus the end of the well casing.

In the Fleming U.S. Pat. No. 4,715,439 there is disclosed a well cap provided for the upper extremity of a circular cylindrical casing wall of a well for potable water. The covering supports a pump positioned within the well and provides thermal insulation so that the water will not freeze when pumped from the well to underground distributor lines. The covering or cap is comprised of a lower member having an outer vertical sidewall and interiorly disposed support beams, an upper member which seals the lower member, and a cylindrical tube that transfers water from the well to underground distributor lines.

In the Howard U.S. Pat. No. 4,747,453 there is disclosed a security cover and housing for a well. The security cover and housing secures and protects a well and more particularly a well pipe. The well cover and housing comprises an open cylindrical main housing with an outwardly projecting flange that is designed to support the cylindrical housing within the well opening. A well pipe retainer insert fits within the cylindrical housing and generally surrounds and supports an upwardly projecting well pipe. A locking plate is adapted to be secured over the well pipe retainer and the well pipe. A top plate is adapted to fit onto the cylindrical opening of the main housing structure about the top portion thereof to form a closed flat upper surface.

A lockable well cap is provided in U.S. Pat. No. 4,848,458 for capping the upper end of a well casing. A base member, which has an upwardly and inwardly interior surface with tapered upwardly directed serrations formed thereon, frictionally engages a portion of the well casing. The outside surface of the base member has a lock tab which aligns with a lock tab on the cover to receive a locking padlock. The cover also includes pins which contact inclined grooves in the base member when properly engaged. A first fluid impervious gasket is seated between the well casing and the base member, and a second fluid impervious gasket is seated between the base member and the cover, both to provide a watertight and waterproof seal.

In the Roser U.S. Pat. No. 5,099,917 there is provided a shallow well installation that can be quickly, easily and economically installed and sealed against surface contamination. The installation provides a continuous plastic pipe well casing extending from ground level to the foot of the well surrounded by a filtration aggregate such as #4 stone and which is sealed by plastic film and/or elastic concrete on top of the stone. The stone extends approximately 18 inches above the water table. A plastic pipe seal and lock are placed at the top of the well casing. A water supply pipe is provided to the house through the side wall of the plastic well casing and, a small plastic pipe is installed outside the well casing within the stone surrounding the plastic well casing extending to the foot for water treatment purposes. The entire well casing installation can be installed in a freshly dug hole or can be used to renovate an existing shallow well casing to upgrade the sanitary rating and to insure against further surface contamination.

A well pipe top cap is disclosed in U.S. Pat. No. 5,184,608. The '608 patent discloses an enclosing pipe cap that has two pivotally interconnected half cylindrical concave pipe end enclosing halves pivotal from an open state to a closed state. The half cylindrical concave halves made of iron, or steel, have half circle enclosing tops and inwardly extended projections at the bottoms that come into upward motion limiting engagement with the bottom of the well pipe top end boss holding the well pipe cap in place in the closed state. In the closed and locked state a cylindrical lock element on one cylindrical concave pipe end enclosing half is mounted for being in alignment with and between two cylindrical lock elements on the other pipe end enclosing half, and an "L" shaped lock rod element is inserted through the aligned lock elements. The top branch of the lock rod element is lowered into a "U" shaped bracket welded in place on the top of one of the half circle enclosing tops and a padlock is locked in place with a portion of its hasp loop extended through aligned openings in opposite sides of the "U" shaped bracket. A lifting handle is welded on the top of the other semicircle enclosure top.

BRIEF SUMMARY OF THE INVENTION

The present invention provides an improved well capping apparatus that enables a well to be capped in a sanitary fashion and that also provides multiple apertures that are specially configured and positioned to enable piping, electrical, sampling and lifting functions as well as other functions to be handled expeditiously.

The present invention includes a body that can be a three section body, including an upper body section, a lower body section and an annular sealing member that fits in between the upper and lower body sections.

The upper body section includes an upper surface, a side and a lower surface portion, the lower surface portion including a downwardly facing socket that conforms generally to the upper end portion of the well pipe and protectively covers it. The lower body section and sealing member each are preferably annular members that encircle the well pipe at a position below the upper body section.

Upon assembly, a connection such as a bolted connection can be used to hold the upper body section and lower body section together, sandwiching the sealing member there between. The sealing member can also be configured to form a seal against the outer surface of the upper end portion of the well pipe.

The body provides a central cavity for conveying water through the body. A pair of larger diameter apertures on the upper body section each communicates with the central cavity, at least one of the larger diameter apertures being on the upper surface of the upper body section.

A plurality of smaller diameter apertures are provided on the upper body section, each communicating with the central cavity.

A plurality of water conveying flow lines are connected (preferably removably connected) to the upper body section so that water flowing in the flow lines communicates with water in the central cavity. At least one of the flow lines is generally vertically oriented and is contained within the well pipe. In this fashion, it can convey water from a down hole pump upwardly to the well cap body.

The other flow line is preferably a water discharge flow line that is attachable at the well head to the outer surface of the upper body section and one of the larger diameter apertures.

A plurality of fittings are provided that are connectable to the upper body section at selected of the apertures. The plurality of fittings include at least two fittings during use that are selected from the group comprised of: a safety valve, an electrical supply fitting, a vent tube fitting, a sealing plug fitting, a sample dispensing spigot, a lifting fitting and a pump support hanger fitting.

The flow lines preferably include a discharge flow line that discharges water from the body, the discharge flow line preferably being removably connectable to one of the larger diameter apertures.

The flow lines can include threaded end portions that enable each flow line to be threadably attached to the body, and wherein each of the larger diameter apertures is correspondingly threaded with internal threads.

The upper body section preferably has at least one of the larger diameter apertures on its upper surface. This larger diameter aperture on the upper surface of the body can be used to either receive a lifting member or blind plug or a discharge flow line.

At least one of the larger diameter apertures is also provided on the side wall of the body. This side mounted larger diameter aperture is preferably used to receive a discharge flow line.

The upper body section upper surface has at least one smaller diameter aperture and preferably a plurality of smaller diameter apertures. The smaller diameter apertures receive selected fittings such as, for example, a vent tube fitting, an electrical supply fitting such as a conduit connecting member, or a hanger for providing support so that a pump can be supported from the well cap apparatus using a rope or other cable.

The side of the body can also provide one or more smaller diameter apertures. These small diameter apertures can receive selected fittings such as, for example, a sample dispensing spigot, a safety valve, or a closure plug.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 4:
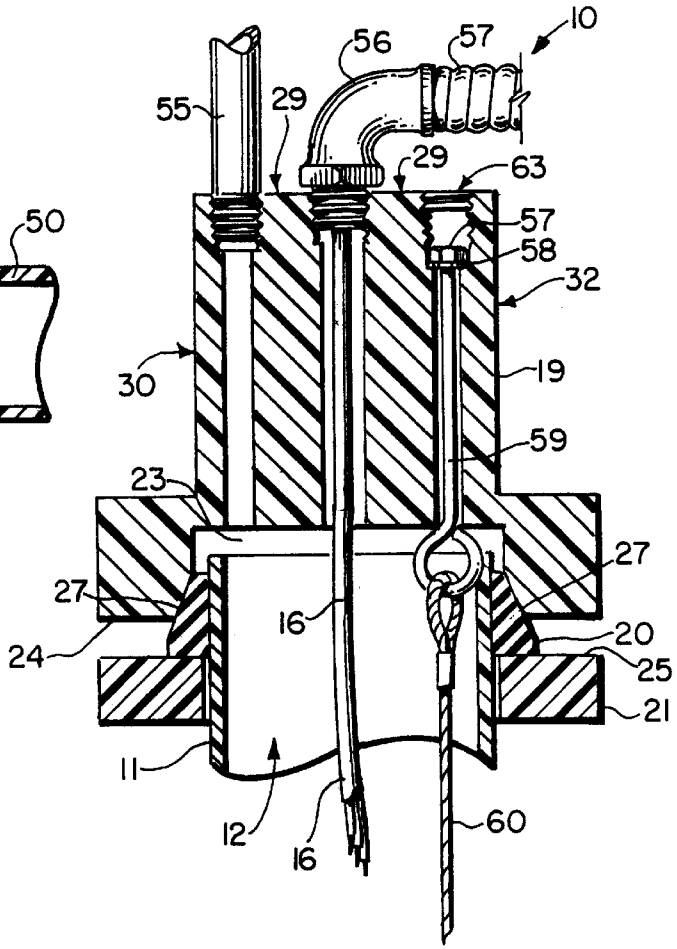
FIG. 4 is a sectional view taken along lines 4—4 of FIG. 2.
Figure 5:
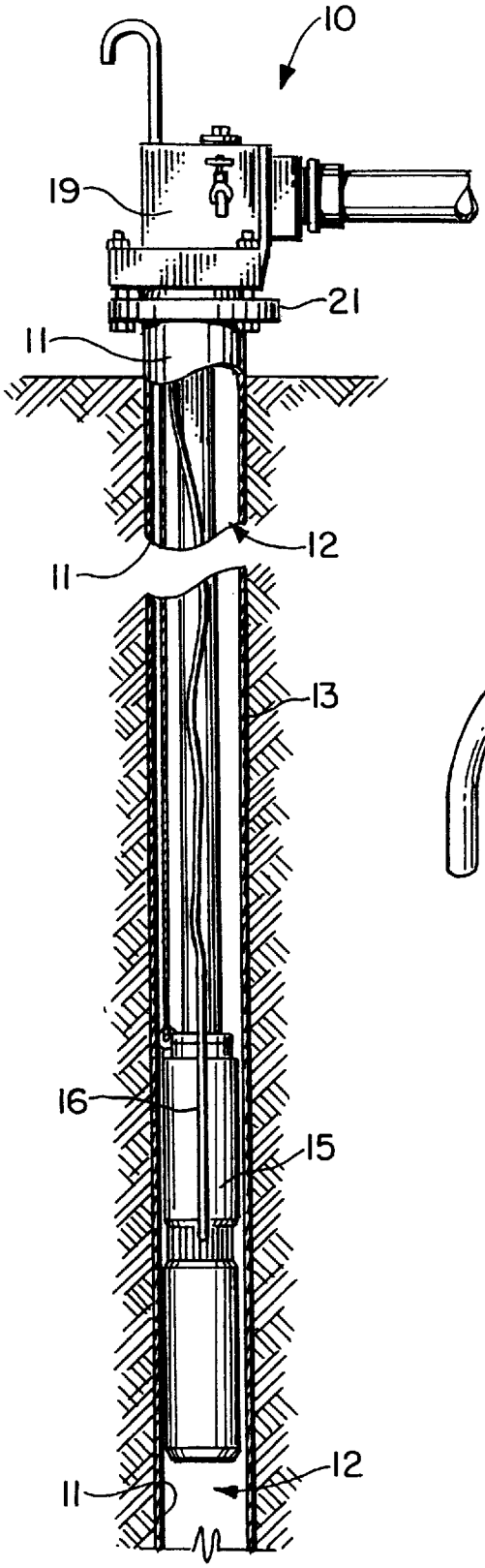
FIG. 5 is a sectional, elevation view of the preferred embodiment of the apparatus of the present invention shown at the wellhead above a water well.

Well cap apparatus 10 is shown in FIGS. 1–4 mounted at the upper end portion of a well pipe 11. Well pipe 11 is shown in FIG. 5 in a schematic diagram of a typical water well. The well pipe 11 provides a wellbore 12. Pump 15 is lowered a desired distance into the wellbore 12 and supported using a rope or cable. An electrical supply line 16 supplies electricity from the wellhead area to the pump 15. The pump 15 communicates with a vertically positioned discharge pipe 13 that has a bore 14 for conveying water from the pump 15 to the well cap apparatus 10. Vertical discharge pipe 13 can have an externally threaded end portion 17.

Figure 1:
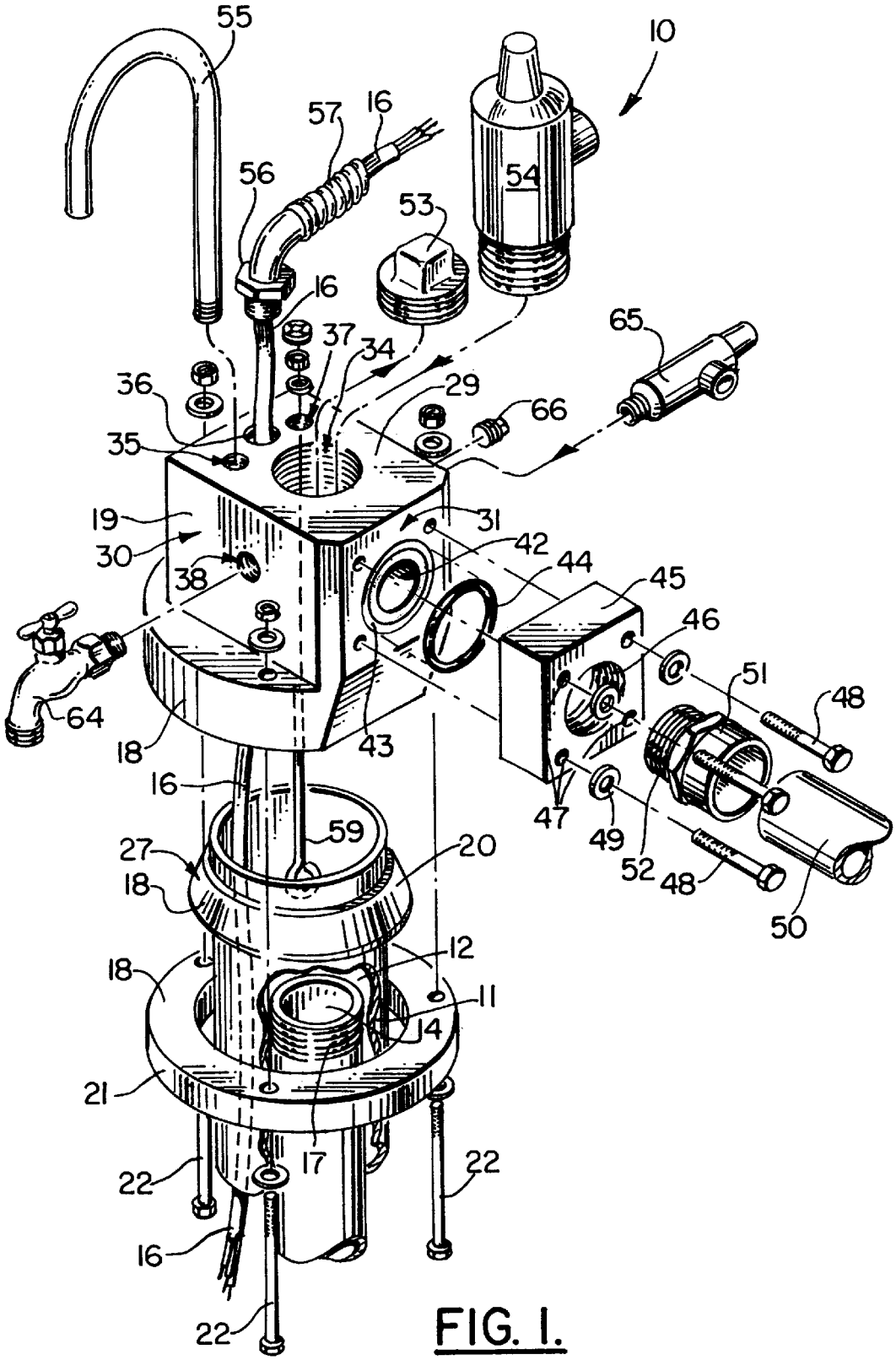
FIG. 1 is an exploded perspective view of the preferred embodiment of the apparatus of the present invention.
Figure 3:
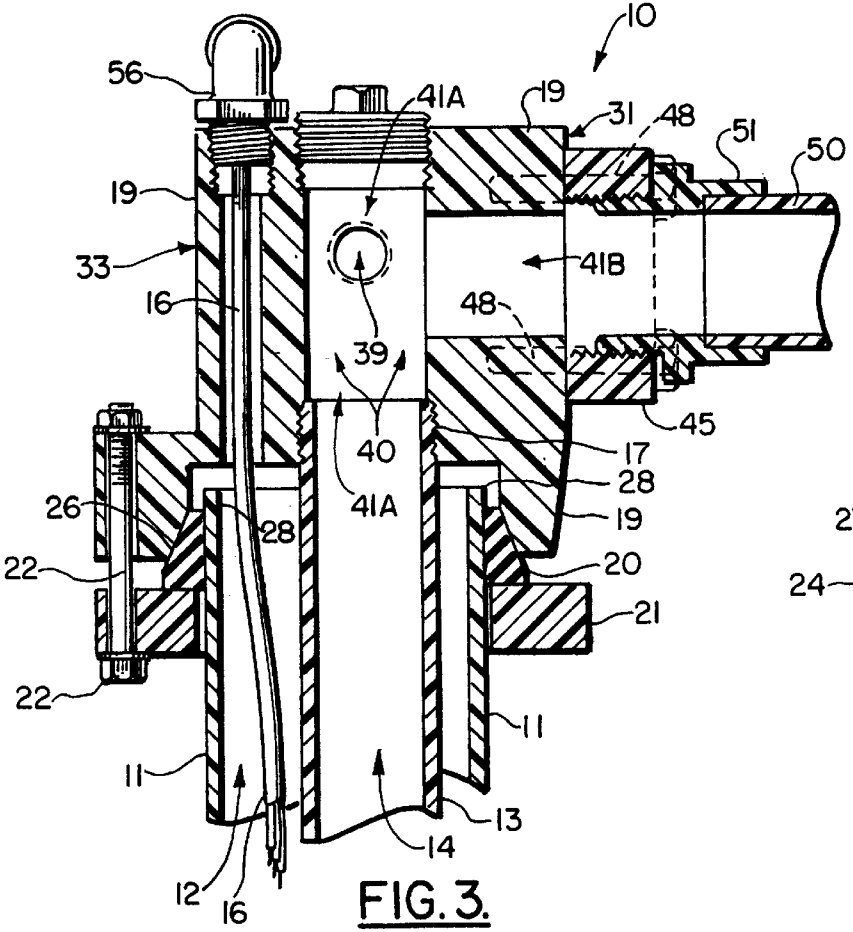
FIG. 3 is a sectional view taken along lines 3—3 of FIG. 2.

Well cap body 18 can be a multi-section assembly that includes upper section 19, lower section 21, and gasket 20. The gasket 20 is preferably a ring or annular gasket 20 as shown in FIGS. 1, 3 and 4. A plurality of bolted connections 22 can be used to secure the upper 19 and lower 21 sections together, sandwiching ring gasket 20 there between as shown in FIGS. 3 and 4. In this fashion, upper section 19 completely covers and surrounds the upper end portion 28 of well pipe 11. Lower section 21 and ring gasket 20 complete a sanitary sealed, covering connection between upper end portion 28 of well pipe 11 and well cap body 18.

Upper section 19 of body 18 has a downwardly facing cylindrical socket 23 that fits over and receives the upper end portion of well pipe 11, as shown in FIGS. 3 and 4. Upper body section 19 also provides a downwardly facing flat annular surface 24 and a beveled or tapered annular surface 27. Gasket 20 provides a correspondingly positioned, beveled or tapered annular surface 26 that fits against the beveled or tapered annular surface 27 of upper section 19 as shown in FIG. 4. Once the sections 19, 21 are bolted together using bolted connections 22, the gasket is compressed and seals against both sections 19, 21 and well pipe 11. This completed assembly as mounted to the top of well pipe 11 is shown in FIGS. 3 and 4. In this position, the well cap body 18 forms a seal and a complete closure over the upper end portion 28 of well pipe 11.

Upper body section 19 has a central cavity 40 and multiple openings or apertures that receive various components as will be described more fully hereinafter. Cavity 40 includes vertical section 41A and horizontal section 41B. The upper body section 19 has an upper surface 29, and a plurality of slide surfaces 30–33. Upper surface 29 of body 18 provides a plurality of apertures 34-37. Aperture 34 is a larger diameter, preferably internally threaded aperture that selectively receives either plug 53 or safety valve 54. The apertures 35, 36, 37 are preferably smaller diameter apertures that receive vent fitting 55, electrical supply line 16, and pump hanger 55.

Figure 6:
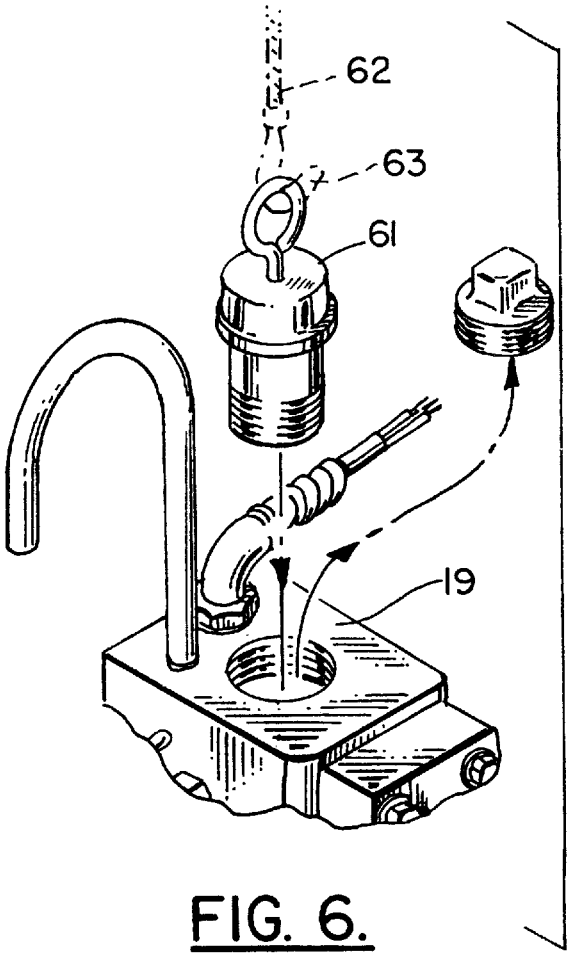
FIG. 6 is a partial perspective view of the preferred embodiment of the apparatus of the present invention.

In FIGS. 1 and 3, plug 53 is shown to optionally close aperture 34 by threadably engaging it. Instead of attaching plug 53 to opening 34, safety valve 54 can be threadably engaged with aperture 34 if desired. As shown in FIG. 6, a lifting fitting 61 can attach to cap body 18. When attached to hook 63 and rope 62, this enables removal of cap 18 and all items attached to it.

Figure 2:
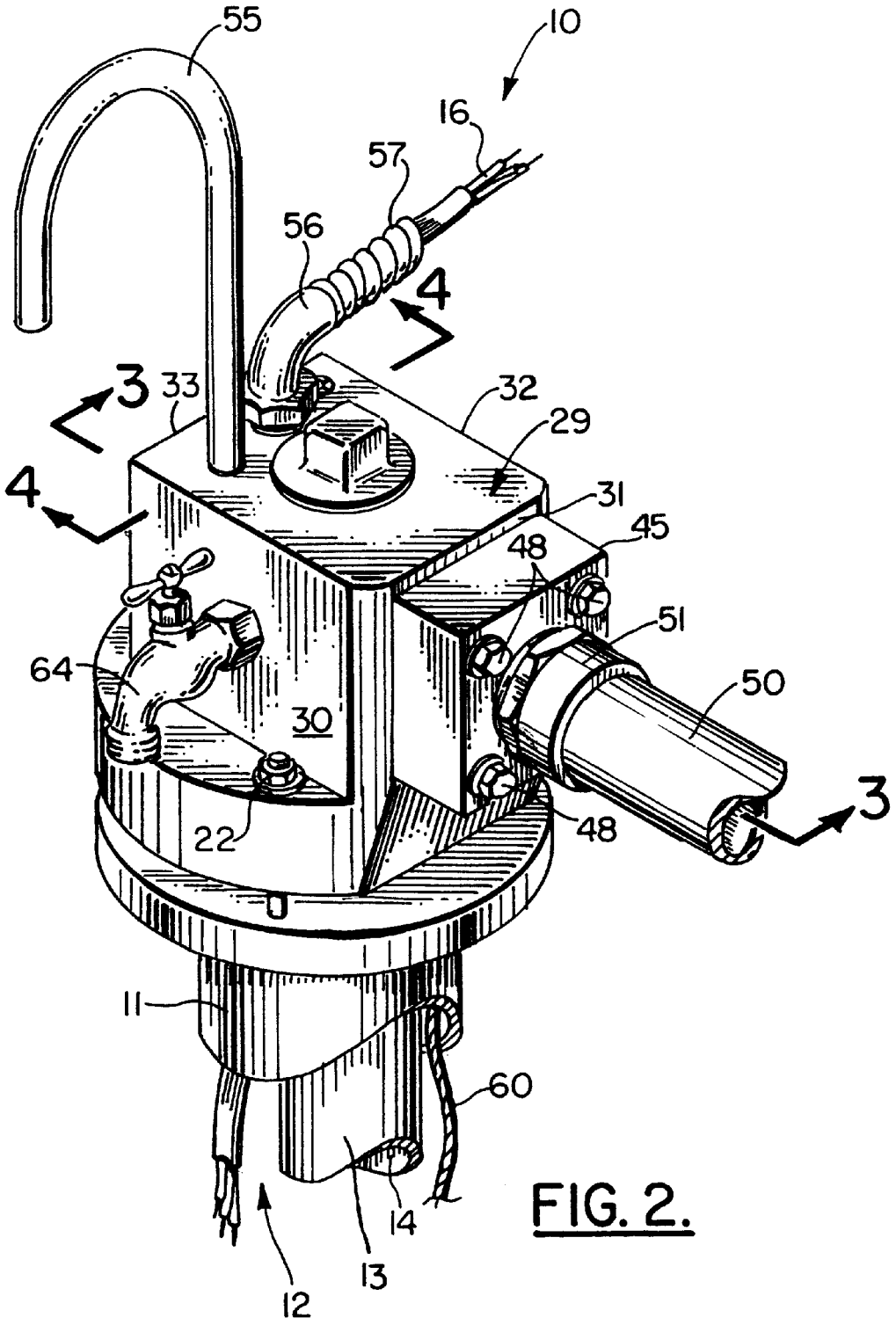
FIG. 2 is a perspective view of the preferred embodiment of the apparatus of the present invention.

The small aperture 35 can be used to support vent tube fitting 55. Small aperture 36 can be used to receive electrical conduit coupling 56 for attaching conduit 57 to well cap body 18 as shown in FIGS. 1 and 2.

The internally threaded small aperture 37 accepts a nut 57 and washer 58 that connect with hanger 59 as shown in FIG. 4. Aperture 37 can then be closed using threaded plug 63.

Aperture 38 on side surface 30 communicates with cavity 40. The aperture 38 is preferably internally threaded to receive a dispensing spigot 64 for dispensing water such as for sampling. Generally opposite aperture 38 can be provided another internally threaded aperture 39 that can be provided with a relief valve 65 or closed with plug 66.

PARTS LIST

The following is a list of suitable parts and materials for the various elements of the preferred embodiment of the present invention.

| PART NO. | DESCRIPTION |
|---|---|
| 10 | well cap apparatus |
| 11 | well pipe |
| 12 | well bore |
| 13 | vertical discharge pipe |
| 14 | bore |
| 15 | pump |
| 16 | electrical supply line |
| 17 | threaded end portion |
| 18 | well cap body |
| 19 | upper section |
| 20 | ring gasket |
| 21 | lower section |
| 22 | bolted connection |
| 23 | cylindrical socket |
| 24 | annular surface |
| 25 | annular surface |
| 26 | tapered annular surface |
| 27 | tapered annular surface |
| 28 | upper end portion |
| 29 | upper surface |
| 30 | side surface |
| 31 | side surface |
| 32 | side surface |
| 33 | side surface |
| 34 | aperture |
| 35 | aperture |
| 36 | aperture |
| 37 | aperture |
| 38 | aperture |
| 39 | aperture |
| 40 | cavity |
| 41A | cylindrical cavity section |
| 41B | cylindrical cavity section |
| 42 | aperture |
| 43 | annular groove |
| 44 | O-ring |
| 45 | sealing block |
| 46 | internally threaded bore |
| 47 | opening |
| 48 | bolt |
| 49 | washer |
| 50 | horizontal discharge pipe |
| 51 | fitting |
| 52 | externally threaded end |

-continued

| PART NO. | DESCRIPTION |
|---|---|
| 53 | plug |
| 54 | safety valve |
| 55 | vent tube fitting |
| 56 | coupling |
| 57 | nut |
| 58 | washer |
| 60 | hanger |
| 61 | lifting fitting |
| 62 | rope |
| 63 | threaded plug |
| 64 | spigot |
| 65 | relief valve |
| 66 | plug |

The foregoing embodiments are presented by way of example only; the scope of the present invention is to be limited only by the following claims.

What is claimed is:

1. A well capping apparatus for capping a generally vertically positioned well pipe, comprising:

a) a body that includes an upper body section, a lower body section and an annular sealing member that fits in between the upper and lower body sections, the upper body section having an upper surface, a side wall and a lower surface portion, the lower surface portion including a downwardly facing socket that conforms generally to the upper end portion of the well pipe and protectively covers it, the lower body section and sealing member each being annular members that encircle the well pipe below the upper body section;

b) a central cavity within the upper section of the body;

c) a pair of larger diameter apertures on the upper body section, each communicating with the central cavity, at least one of the larger diameter apertures being on the upper surface of the upper body section;

d) a plurality of smaller diameter apertures on the upper body section, each communicating with the central cavity;

e) a plurality of water conveying flow lines that are connected to the upper body section so that water flowing in the flow lines communicates with water in the central cavity, at least one of the flow lines being a generally vertically oriented flow line that is contained within the well pipe, the other flow line being a water discharge flow line that is attachable the upper body section at one of the larger diameter apertures, and at a position away from the other water conveying flow line; and f) a plurality of fittings that are connectable to the upper body section at selected of the apertures, the plurality of fittings being at least two fittings selected from the group consisting of a safety relief valve, an electrical supply fitting, a vent tube fitting, a sealing plug fitting, a sample dispensing spigot, a lifting fitting, and a pump support hanger fitting.

2. The well capping apparatus for capping a generally vertically positioned well pipe of claim 1 wherein the flow lines include a discharge flow line that discharges water from the body.

3. The well capping apparatus for capping a generally vertically positioned well pipe of claim 1 wherein the flow lines include threaded end portions that enable each flow line to be threadably attached to the body.

4. The well capping apparatus for capping a generally vertically positioned well pipe of claim 1 wherein the upper body section side wall has at least one larger diameter aperture.

5. The well capping apparatus for capping a generally vertically positioned well pipe of claim 1 wherein the upper body section upper surface has at least one smaller diameter aperture.

6. The well capping apparatus for capping a generally vertically positioned well pipe of claim 1 wherein the upper body section upper surface has at least a plurality of smaller diameter apertures.

7. The well capping apparatus for capping a generally vertically positioned well pipe of claim 1 wherein the upper body section side wall has at least one smaller diameter aperture.

8. The well capping apparatus for capping a generally vertically positioned well pipe of claim 1 wherein the upper body section side wall has a plurality of smaller diameter apertures.

9. A well pipe and capping apparatus for capping a generally vertically positioned well pipe, comprising:

a) a generally vertically oriented well pipe having a well annulus and an upper end portion the is positioned at a well head;

b) a body having an upper surface, a side wall and a lower surface portion, the lower surface portion including a downwardly facing socket that fits the upper end portion of the well pipe and protectively covers it, the body including an annular portion that encircles the upper end portion of the well pipe;

c) a water conveying central cavity within the body;

d) a pair of larger diameter apertures on the body, each communicating with the central cavity;

e) a plurality of smaller diameter apertures on the body, each communicating with the central cavity;

f) first and second water conveying flow lines that are connected to the body so that water in the flow lines communicates with water in the central cavity, the first of the flow lines being a generally vertically oriented flow line that is contained within the well pipe, the second flow line being attachable to the body at one of the larger diameter apertures;

g) a plurality of fittings that are each connectable to the body at selected of the apertures, the plurality of fittings being at least two fittings selected from the group consisting of a safety relief valve, an electrical supply fitting, a vent tube fitting, a sealing plug fitting, a sample dispensing spigot, a lifting fitting, and a pump support hanger fitting.

10. The well capping apparatus for capping a generally vertically positioned well pipe of claim 9 wherein the flow lines include a discharge flow line that discharges water from the body.

11. The well capping apparatus for capping a generally vertically positioned well pipe of claim 9 wherein the flow lines include threaded end portions that enable each flow line to be threadably attached to the body.

12. The well capping apparatus for capping a generally vertically positioned well pipe of claim 9 wherein the body upper surface has at least one larger diameter aperture.

13. The well capping apparatus for capping a generally vertically positioned. well pipe of claim 9 wherein the body side wall has at least one larger diameter aperture.

14. The well capping apparatus for capping a generally vertically positioned well pipe of claim 9 wherein the body upper surface has at least one smaller diameter aperture.

15. The well capping apparatus for capping a generally vertically positioned well pipe of claim 9 wherein the body upper surface has at least a plurality of smaller diameter apertures.

16. The well capping apparatus for capping a generally vertically positioned well pipe of claim 9 wherein the body side wall has at least one smaller diameter aperture.

17. The well capping apparatus for capping a generally vertically positioned well pipe of claim 9 wherein the body side wall has a plurality of smaller diameter apertures.

18. The well capping apparatus of claim 9 wherein each of the larger diameter apertures is in the form of a cylindrical socket that enables a pipe section to be fitted thereinto.

19. The well capping apparatus of claim 18 wherein the sockets are each threaded.

20. A well pipe and capping apparatus for capping a generally vertically positioned well pipe, comprising:

a) a generally vertically oriented well pipe having a well annulus and an upper end portion the is positioned at a well head;

b) a body having an upper surface, a side wall and a lower surface portion, the lower surface portion including a downwardly facing socket that fits the upper end portion of the well pipe and protectively covers it, the body including an annular portion that encircles the upper end portion of the well pipe;

c) a water conveying central cavity within the body;

d) a pair of larger diameter apertures on the body, each communicating with the central cavity;

e) a plurality of smaller diameter apertures on the body, each communicating with the central cavity;

f) first and second water conveying flow lines that are connected to the body so that water in the flow lines communicates with water in the central cavity, the first of the flow lines being a generally vertically oriented flow line that is contained within the well pipe, the second flow line being attachable to the body at one of the larger diameter apertures;

g) a plurality of fittings that are each connectable to the body at selected of the apertures, the plurality of fittings including at least an electrical supply fitting, a pump support, a water dispensing fitting and vent fitting.

* * * * *